United States Patent [19]

Rutherford

[11] 4,074,478

[45] Feb. 21, 1978

[54] DRYWALL BEAD ACCESSORY

[76] Inventor: Barry A. Rutherford, 10008 Forbes, Sepulveda, Calif. 91343

[21] Appl. No.: 664,481

[22] Filed: Mar. 8, 1976

[51] Int. Cl.[2] ..... E04B 5/57

[52] U.S. Cl. ..... 52/98; 52/256; 52/288

[58] Field of Search ..... 52/98–100, 52/254–257, 288

[56] References Cited

U.S. PATENT DOCUMENTS

| | | | |
|---|---|---|---|
| 2,552,159 | 5/1951 | Eason | 52/98 |
| 3,290,838 | 12/1966 | Van Bael | 52/254 |
| 3,460,302 | 8/1969 | Cooper | 52/288 |
| 3,638,374 | 2/1972 | Harby | 52/100 |

OTHER PUBLICATIONS

*Red Book of Lathing & Plastering* by United States Gypsum, p. 34, copyright 1967, U.S.G.

*Primary Examiner*—Price C. Faw, Jr.
*Assistant Examiner*—Henry Raduazo
*Attorney, Agent, or Firm*—Christie, Parker & Hale

[57] ABSTRACT

A T-shaped drywall casing bead having a removable tear strip portion. The casing bead includes a first strip corresponding to the leg of the T-shaped structure having a lip or bead formed along the fixed end thereof and a second and third strip corresponding to the cross bar portion of the T-shaped structure. A portion or all of the third strip is removable along an intentionally weakened line to provide the tear strip. Drywall finishing compound or material deposited on the tear strip is removed when the tear strip is removed. Various configurations of the casing bead are described.

5 Claims, 4 Drawing Figures

DRYWALL BEAD ACCESSORY

BACKGROUND OF THE INVENTION

This invention relates to drywall construction and in particular to a casing bead with removable tear strip for use in filling and finishing the space between the top and side edges of drywall panels and surfaces adjacent thereto.

DISCUSSION OF THE PRIOR ART

In the construction of interior walls and partitions using gypsum wallboard ("drywall"), wallboard panels are cut to size and put in place by masking or fastening them to metal studs. In the usual case a small space is left at the top and sides of the drywall panels between the edges of the panel and the ceiling, and masonry columns and the like, after the panels are fastened to the studs. In finishing walls or partitions it is necessary to fill the space to eliminate the otherwise unsightly gap.

In the prior art this was accomplished by the use of a two-sided structure consisting of two elongated legs or strips joined along one edge and oriented at approximately right angles to each other. A rounded edge or bead is defined at the point of juncture between the two legs. In use the two-sided structure, called a "casing bead" has one leg inserted in the space between the drywall and the adjacent surface such that the rounded edge or bead bears against the adjacent surface and the second leg overlaps the drywall panel. This second leg of the casing bead is affixed to the drywall by nails or other fasteners to hold the assembly in position with the bead flush and bearing against the adjacent surface. The finishing operation is completed by covering the second leg with tape to cover the fasteners and the edge of the leg. The tape is covered with a taping compound which is carefully applied to provide a smooth continuous surface extending from the surface of the drywall across the second leg and into abutment with the rounded edge or bead. In the course of applying the taping compound over the tape, it is not unusual that an amount of the compound is extruded or spread past the edge of a putty knife or other tool used to apply the compound beyond the edge of the bead and onto the adjacent surface, namely, the ceiling tiles or masonry column.

To avoid this problem, it has been common in the prior art to apply tape on the adjacent surface along a line exactly adjacent the bead to a point removed from the casing bead structure. Any excess compound which flows over the edge of the bead deposits on the tape and not on the ceiling tile or masonry column. When the finishing operation is completed, the tape on the ceiling tile or masonry column is then removed carrying away any splash-over of taping compound. Application and removal of the tape is a time-consuming and costly labor-involving step.

BRIEF SUMMARY OF THE INVENTION

The present invention provides an improved drywall casing bead having a removable tear strip. The invention provides a drywall casing bead comprising a first flat elongated strip adapted to overlie the surface of the drywall panel and a lip formed along one longitudinal edge of said first strip to provide a bed for the application of masking materials. A second flat elongated strip extending from a side of the lip opposite said first strip at approximately right angles to said first strip is also provided. The second strip is adapted to be inserted in the gap between the edge of the drywall panel and the adjacent surface. A third flat elongated strip overlying said second strip on the side thereof facing said adjacent surface is provided, the third strip being connected to the second strip at the edge thereof opposite the lip and having a width significantly greater than the width of said second strip, such that it extends past the lip and overlies the adjacent surface. The third strip is scored and intentionally weakened along a line directly opposite the lip whereby the portion of said third strip extending beyond the lip provides a removable tear strip.

The present invention provides a casing bead which eliminates the need for masking tape or the like on the ceiling or column surface adjacent the bead. Whereas, heretofore, a margin had to be provided on the surface adjacent the drywall to catch any splash-over of finishing material a tear strip is now provided which is formed with and made part of the casing bead such that the tear strip is positioned to automatically catch any splash-over upon positioning and securing of the casing bead in position on the drywall with one leg thereof extending into the gap between the adjacent surface of the drywall. The labor step involved in the application and removal of masking tape is now avoided and the finishing operation is simplified and made less costly by providing a tear strip which is grasped by a pliers or like tool and pulled or torn away after all finishing operations on the drywall have been completed.

BRIEF DESCRIPTION OF THE DRAWING

These advantages and others will become more apparent by reference to the drawings wherein.

DESCRIPTION OF THE INVENTION

Figure 1:
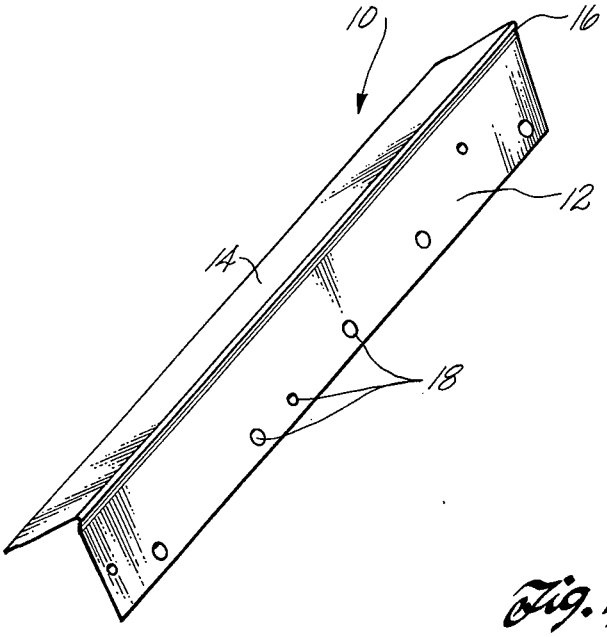
PRIOR ART Fig. 1
FIG. 1 is a perspective view of a casing bead according to the prior art.
Figure 4:
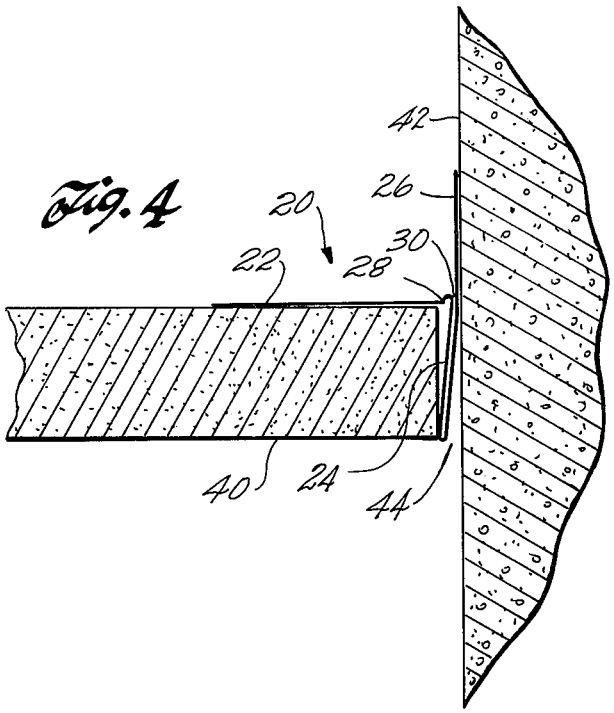
FIG. 4 is a horizontal sectional view showing the use of the present invention along the side of a drywall panel adjacent a masonry wall or column.

A drywall casing bead according to the prior art is shown in FIG. 1. As shown therein a bead 10 is provided which utilizes two flat elongated strips 12 and 14 joined along their fixed edges and formed so as to provide a lip or bead 16. Strip 12 is adapted to overlie the front surface of the drywall with which the bead is to be used and strip 14 is adapted to be inserted into the space at the top or sides of the drywall panels between the ceiling or adjacent wall or column. Apertures 18 are provided in the strip 12 for receiving fasteners whereby the bead 10 is affixed and secured to the drywall. Bead 16 defines a lip raised approximately ⅛ of an inch above the surface of the strip 12. During finishing, masking material, such as tape or masking compound, is overlaid on the strip 12 from the edge of lip 16 across strip 12, the free edge 13 of strip 12 and onto the drywall to provide a smooth surface for painting. The lip 16 provides a curb or margin for accumulation of the masking material as it is applied by a putty knife or the like.

Such a configuration is characterized by a problem in that the masking material tends to splash over or or be spread over lip 16 and small amounts are deposited or smeared upon the adjacent ceiling or wall surface. To avoid this problem, tape is applied to the adjacent surface after the casing bead is placed in position and secured by means of apertures 18 such that the edge of the tape adjacent to lip 16 is laid slightly interiorly of the leading edge of the lip 16 so that any splash-over accumulates on the tape and is thereafter removed after the finishing operation is completed when the tape is removed.

Figure 2:
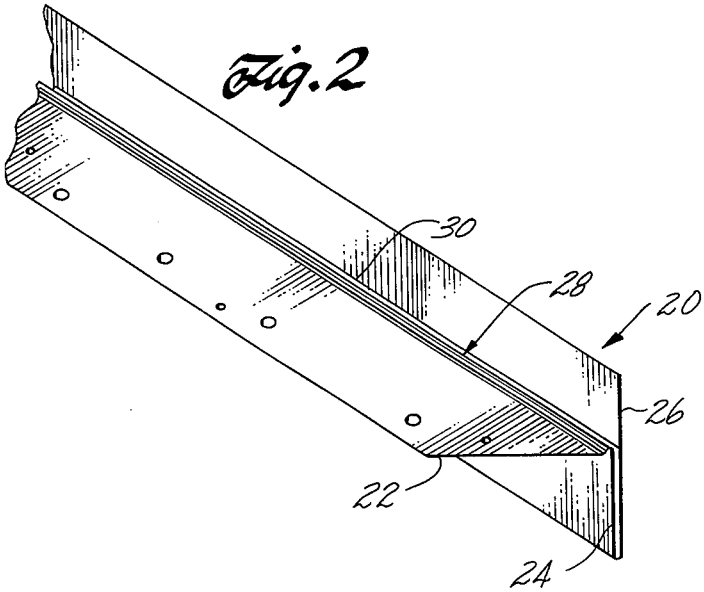
FIG. 2 is a perspective view of a casing bead according to the present invention.

A drywall casing bead according to the present invention is shown in FIG. 2. As shown therein the invention comprises a bead 20, a first flat elongated strip 22, a second flat elongated strip 24 and a third flat elongated strip 26. Strip 22 corresponds to strip 12 of the prior art, and as in the case of the prior art casing bead, is joined to strip 24 along one edge to form a bead or lip 28. As shown in FIG. 2, strips 22 and 24 are oriented at approximately right angles to each other with the lip extending approximately ⅛ of an inch above or beyond the surface of a strip 22 to provide the bead or margin for finishing materials. A strip 26 is connected to and integrally formed with strip 24 at the edge of strip 24 removed from the line of juncture of strips 22, 24. Strip 26 which has a width substantially greater than the width of strip 24 and thus extends a significant distance beyond lip 28 at approximately a right angle to strip 22 to form a T-shaped structure. Strip 26 is scored and weakened along line 30. This enables the portion of strip 26 between line 30 and the free edge thereof to constitute a removable tear strip, the use of which will be described in conjunction with the description of the invention as depicted in the following two figures of the drawing.

Figure 3:
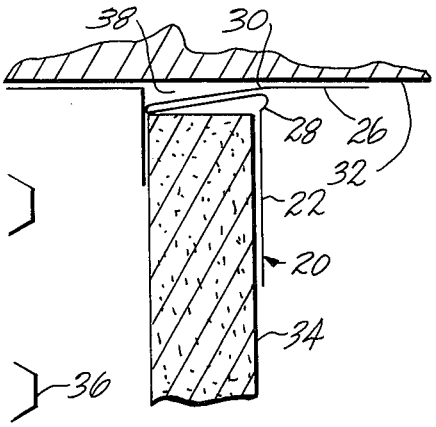
FIG. 3 is an elevation view in section showing the application of the present invention as used along the top of a drywall panel adjacent acoustic tile.

As shown in FIG. 3 the casing bead 20 according to the present invention is mounted at the top of a drywall panel, such that the casing bead fills the gap between the top edge thereof and the acoustic tile 32 defining the ceiling above the drywall. The drywall 24 is held in position by being affixed to metal studs 36 with the tops of the acoustic tiles overlaying the tops of the studs. As shown strip 24 and a portion of strip 26 of casing bead 20 is placed in the gap 38 between the top of the drywall and the adjacent surface of acoustic tile such that at least a portion of strip 26 overlies and is in contact with the acoustic tile. Likewise this positions strip 22 such that it extends down from the top of the drywall over a portion of the exterior surface. In the finishing operation, masking tape and masking finishing compound are applied to strip 22 to overlap the free edge of strip 22 and to provide a smooth unmarked surface extending from the exterior surface of drywall 34 to the lip 28. It can be seen that as masking compound is applied over strip 22 by means of a putty knife or the like, a certain amount of material can be extruded or splashed over the apex of lip 28 and onto the exposed surface of strip 26. When the finishing operation is completed, the exposed portion of strip 26 is bent away from the ceiling tile and grasped with a tool such as a pliers and separated from the body portion of the casing bead along line 30 carrying away any excess masking material.

The same principle of operation applies to the drywall casing bead of the present invention as it is used along the sides of drywall in the gap between the side edges of a drywall panel 40 and an adjacent wall surface such as a masonry column 42. The casing bead 20 is inserted in the gap 44 between the side edge of the panel and masonry wall 42 such that strip 22 overlies the exterior surface of the drywall and the exposed portion of strip 26 overlies a portion of the exterior surface of the masonry wall. Strip 24 and the portion of strip 26 located interiorly of lip 28 extend into the gap. The casing bead is then secured by means of apertures 28 in strip 22 to the drywall to hold the casing bead in position. The finishing operation is then completed by the application of tape and masking material, not shown, overlying strip 22 and extending beyond the free edge thereof onto the drywall to again provide a smooth unmarked surface suitable for painting and the like. When all finishing operations are completed, the exposed portion of strip 26 becomes a tear strip which is removed along line 30 carrying away any masking material.

The casing bead as shown in FIG. 2 is an integral T-shaped structure with the point of juncture of the second and third strips 24, 26 located along a line removed from the location of the bead. Other configurations contemplated include a structure in which the third strip is joined directly to the bead 28 along a scored or weakened line for easy removal and one in which the third strip is a completely separate strip secured to the second strip by adhesives, spot welding or the like. Again, the free portion of such a third strip is preweakened along a line opposite the margin or lip of the casing bead to provide a removable tear strip.

In addition to its utility with conventional drywall, the casing bead of the present invention is generally useful with partitioning and paneling of all types wherein finishing is needed at the top and sides of precut or presized panels. Such other types include wallboard which is referred to as thinwall. Thinwall is a type of gypsum partitioning wherein thin panels are secured to wood or metal studs and the casing bead is then secured in position to the panels. Thereafter a thin coat of plaster called a veneer plaster is applied over the entire surface of the panel and the portion of the casing bead overlying the surface of the panel complete the finishing process.

What is claimed is:

1. A drywall casing bead comprising:

a first flat elongated strip adapted to overlie the surface of the drywall;

a lip formed along one elongated edge of said first strip to provide a bead for the application of masking materials;

a second flat elongated strip extending from the side of the lip opposite said first strip at approximately right angles to said first strip, the second strip being adapted to be inserted in a space between the edge of the drywall and an adjacent surface; and a third flat elongated strip, integral with said second strip, extending from the lip in the opposite direction from said second strip to form a T-shaped structure, said third strip being scored and intentionally weakened along a line directly opposite the lip whereby the third strip provides a removal tear strip.

2. A casing bead according to claim 1 wherein the first, second and third strips are an integral extrusion of a structurally stiff material.

3. A casing bead according to claim 2 wherein the second strip and third strip are formed along the edge of the lip opposite the first strip.

4. A casing bead according to claim 2 wherein the third strip is joined to the second strip along the longitudinal edge of the second strip opposite the lip.

5. A drywall casing bead comprising:

a first flat elongated strip adapted to overlie the surface of the drywall;

a lip formed along one elongated edge of said first strip to provide a bead for the application of masking materials;

a second flat elongated strip extending from the side of the lip opposite said first strip at approximately right angles to said first strip, the second strip being adapted to be inserted in a space between the edge of the drywall and an adjacent surface; and a third flat elongated strip, integral with said first strip, extending from the lip in the opposite direction from said second strip to form a T-shaped structure, said third strip being scored and intentionally weakened along a line directly opposite the lip whereby the third strip provides a removal tear strip.

* * * * *